United States Patent [19]

Wiedmeier

[11] 4,423,528

[45] Jan. 3, 1984

[54] TWO PIECE MOLDED FIBERGLASS SHOWER UNIT

[76] Inventor: Charles A. Wiedmeier, 3323 W. Cypress, Phoenix, Ariz. 85009

[21] Appl. No.: 374,444

[22] Filed: May 3, 1982

Related U.S. Application Data

[63] Continuation of Ser. No. 112,083, Jan. 14, 1980, abandoned.

[51] Int. Cl.[3] ..... A47K 3/22

[52] U.S. Cl. ..... 4/613; 4/614; 52/35

[58] Field of Search ..... 4/538, 546, 552, 584, 4/592, 593, 595, 596, 597, 612–614; 52/34, 35, 264, 293, 295, 309.2, 309.16, 80

[56] References Cited

U.S. PATENT DOCUMENTS

| | | | |
|---|---|---|---|
| D. 186,841 | 12/1959 | Everett | 4/596 X |
| 1,749,275 | 3/1930 | Cromwell | 4/614 X |
| 1,993,420 | 3/1935 | Steele et al. | 4/595 X |
| 3,807,105 | 4/1974 | Rudkin et al. | 52/80 X |
| 3,816,234 | 6/1974 | Winfield | 4/538 X |
| 3,827,086 | 8/1974 | Seymour et al. | 52/35 X |

*Primary Examiner*—Stephen Marcus
*Assistant Examiner*—Kenneth S. Putnam
*Attorney, Agent, or Firm*—Sutton & Thomas Cahill

[57] ABSTRACT

A two piece molded fiberglass shower unit includes a square base having a vertical peripheral ridge extending along three sides of the base and a single piece shower wall section. The wall section includes a continuous groove for receiving the ridge. The ridge fits tightly into the receiving groove, preventing leakage of water through the junction between the base and the wall section and rigidly attaching the wall section to the base.

5 Claims, 11 Drawing Figures

FIG. 1
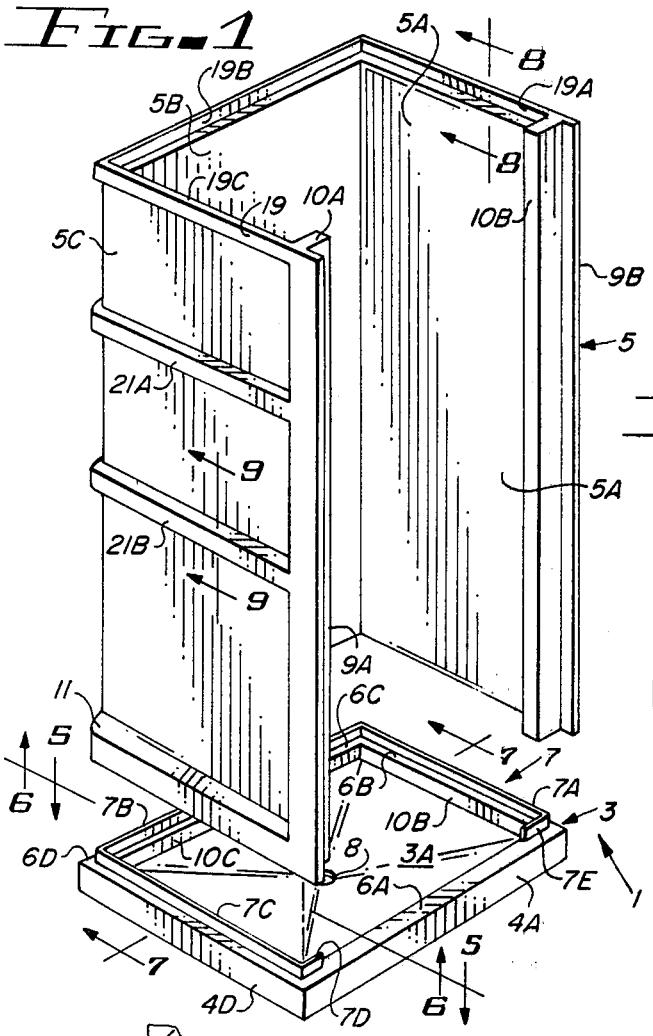
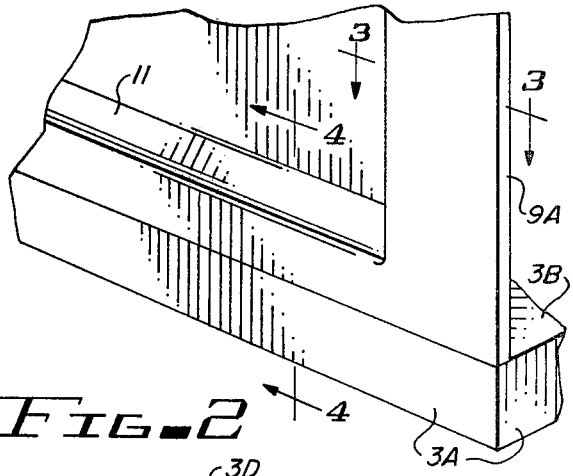
FIG. 2
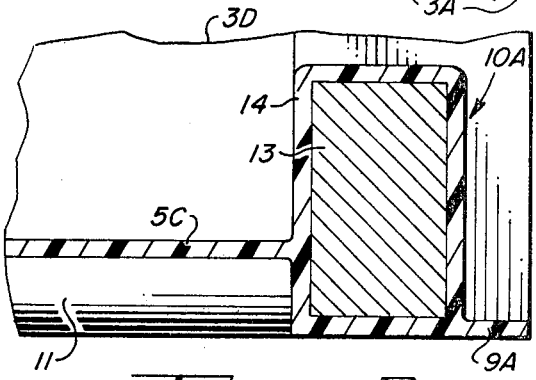
FIG. 3
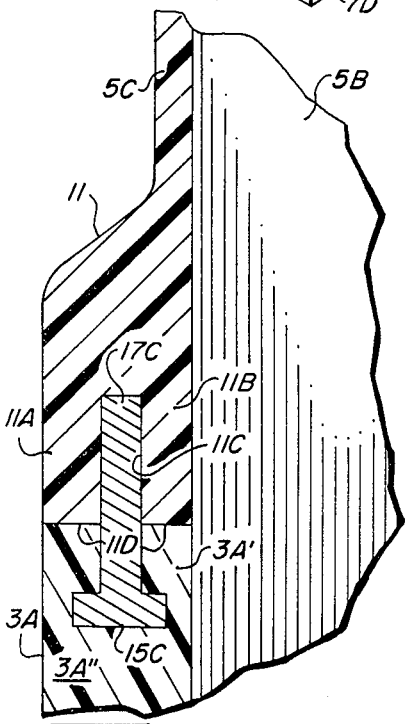
FIG. 4
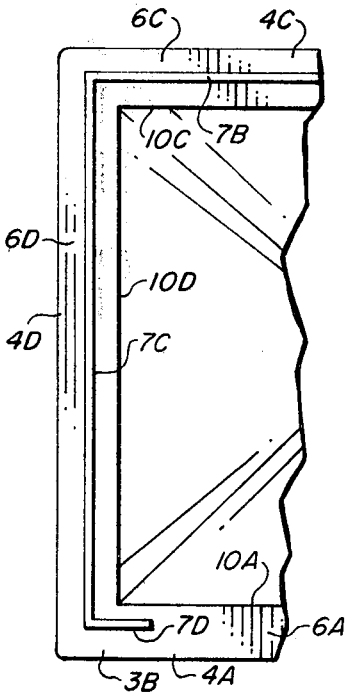
FIG. 5
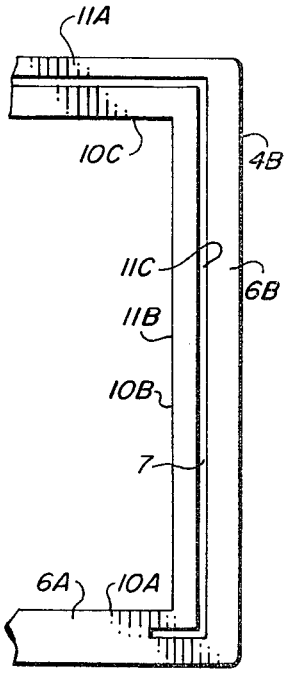
FIG. 6

FIG. 10
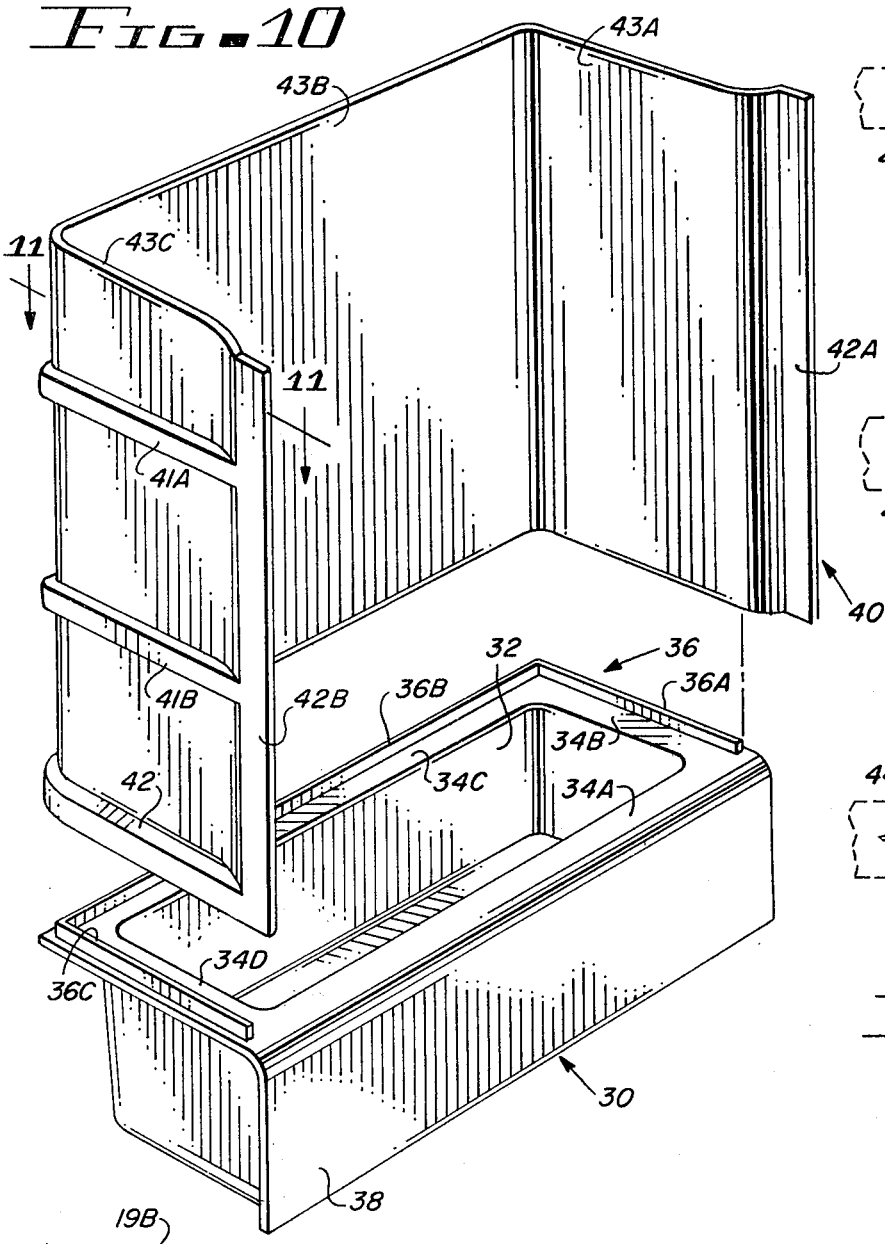
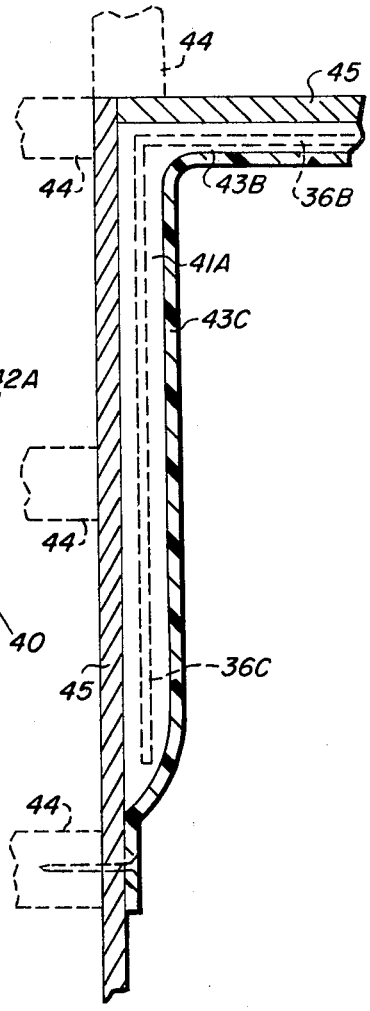
FIG. 11
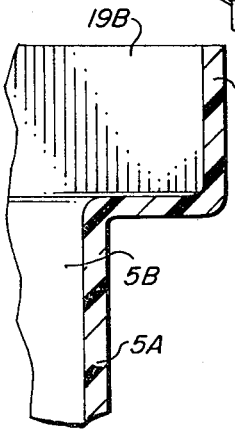
FIG. 8
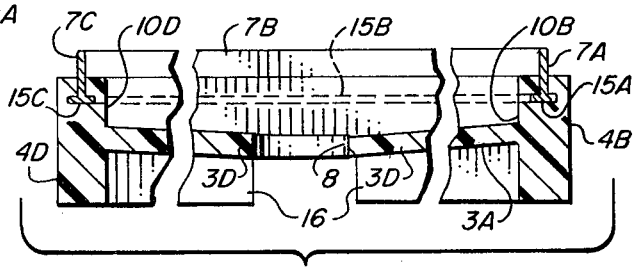
FIG. 7
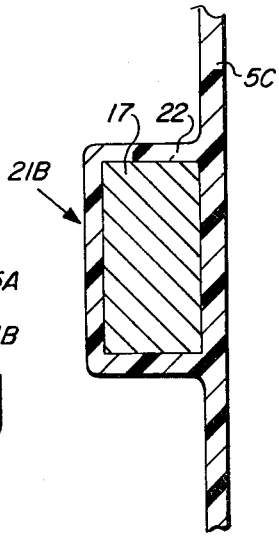
FIG. 9

TWO PIECE MOLDED FIBERGLASS SHOWER UNIT

This is a continuation of application Ser. No. 112,083 filed Jan. 14, 1980, now abandoned.

BACKGROUND OF THE INVENTION

1. Field of the Invention

The invention relates to molded fiberglass shower units, and particularly to molded fiberglass shower units having separate base and wall sections which are connected together during installation of the shower units.

2. Description of the Prior Art

Single piece or unitary molded fiberglass shower units and bathtub units are commonly installed in new houses during the construction of thereof. Since such single piece molded fiberglass shower units and bathtub units are so large that they cannot be passed through bathroom doors of ordinary houses, the single piece shower or bathtub units must be installed before the "framing" or installation of studs of the bathroom walls has been completed. This ordinarily does not present any serious difficulities for new houses which are being constructed.

However, frequently it is desirable to remodel a bathroom of an older house by removing an old bathtub or shower unit. Since tiled wall surfaces are usually provided above the original bathtub or shower base, they can be easily removed through the bathroom door. However, it is usually impossible to pass presently available single piece molded fiberglass bathtub or shower units through a bathroom door, thereby necessitating tearing down of the bathroom door and part of the wall structure. It would be highly desirable to be able to remodel bathrooms by replacing old shower units and bathtubs with modern fiberglass shower or bathtub units, since the latter have many advantages, including relatively low cost, are more easily kept clean, and are safer than prior metal tub or shower base units and tile walls adjacent thereto.

Accordingly, it is one object of the invention to provide a molded fiberglass shower unit or bathtub unit which can be conveniently transported through an ordinary bathroom door for installation in the bathroom without necessitating destruction of part of the bathroom door frame and adjacent wall.

It is another object of the invention to provide a safe, durable, rigid molded fiberglass shower unit or bathtub unit which can be conveniently installed in a bathroom during construction of a house after framing of the bathroom walls.

A variety of shower units are available which include a large number of separate parts, including a base, three separate side walls, numerous bolts and nuts, and complex assembly instructions. Such shower units generally do not provide adequate sealing against water leakage through joints between the various components thereof, and are not as rigid nor as safe, nor as effective or as easy to keep clean as the above described single piece molded fiberglass unit. Further, an undue amount of labor is required to assemble prior "kits" for known assemblable shower units.

Accordingly, another object of the invention is to provide a two piece molded fiberglass shower or bathtub unit which has the advantages of presently available single piece shower or bathtub units.

A novelty search directed to the present invention uncovered U.S. Pat Nos. 2,648,409; 3,757,358 and 4,152,789. These patents disclose assembleable shower units which include a relatively large number of pieces from which their wall sections are constructed. They are not nearly as rigid, durable, or leakproof as single piece molded fiberglass shower units. Further, the shower units shown in the above patents are not as attractive to homeowners as single piece molded fiberglass shower units.

Accordingly, another object of the invention is to provide a two piece molded fiberglass shower tub unit which overcomes the various shortcomings of the above prior art.

SUMMARY OF THE INVENTION

Briefly described and in accordance with one embodiment thereof, the invention provides a two piece molded fiberglass bath unit which can be either a shower unit or a bathtub unit. In the described embodiment of the two piece shower unit, a base section has an upper surface from which a U-shaped sealing ridge extends. The sealing ridge mates with a ridge receiving slot disposed in the bottom edge of a three sided wall section. The sealing ridge snuggly fits within the ridge receiving slot, and can be attached thereto by means of a suitable waterproof cement, preventing leakage of water through the junction between the three sided wall section and the base section and also rigidly attaching the three sided wall section to the base unit. Horizontal reinforcing bars are attached to the outer surfaces of the three sided wall section. Wood beams are enclosed by molded fiberglass material to provide the reinforcing bars on which can lie flush against walls enclosing the three sides of the wall section. Flanges are provided along the edges of the open side of the wall section for attachment to adjacent walls forming the installation region within which the two piece shower unit is installed. The described two piece molded fiberglass shower unit can be easily passed through a pre-existing bathroom door opening after a previously installed shower unit has been removed. The base section and the wall section are fitted together by completely inserting the sealing ridge into the ridge receiving slot. Suitable plastic cement is used to make the resulting junction rigid.

In the bathtub embodiment of the invention, a peripheral U-shaped sealing ridge extends vertically upward from the top surfaces of the bathtub and fits snuggly within a ridge receiving slot of a three sided wall section. The installed structure is similar to the structure of the single piece fiberglass shower unit described above. After an old bathtub has been removed from the bathroom, the new bathtub section and the three sided wall section can be transported through the pre-existing door opening and installed as a unitary rigid unit. Suitable cement is used to secure the sealing ridge within the ridge receiving groove of the three sided wall section.

BRIEF DESCRIPTION OF THE DRAWINGS

FIG. 1 is a perspective exploded view of a two piece molded fiberglass shower unit of the present invention.

FIG. 2 is an enlarged partial perspective view of the lower front corner of the embodiment of FIG. 1 after installation of the shower unit of FIG. 1.

FIG. 3 is a partial sectional view taken along section line 3—3 of FIG. 2.

FIG. 4 is a partial sectional view taken along section line 4—4 of FIG. 2.

FIG. 5 is a partial top view, taken along section line 5—5 of the base of the shower unit of FIG. 1.

FIG. 6 is a partial bottom view taken along section line 6—6 of FIG. 1, of the three sided wall section of FIG. 1.

FIG. 7 is a partial sectional view taken along section line 7—7 of FIG. 1.

FIG. 8 is a partial sectional view taken along section line 8—8 of FIG. 1.

FIG. 9 is a partial sectional view taken along section line 9—9 of FIG. 1.

FIG. 10 is a perspective exploded view of a two piece molded fiberglass bathtub unit.

FIG. 11 is a partial sectional view taken along section line 11—11 of FIG. 10.

DESCRIPTION OF THE INVENTION

Referring now to the drawings, especially to FIG. 1, shower unit 1 includes a molded fiberglass base section 3 and a molded fiberglass wall section 5.

Base section 3 includes a front outer wall 4A, a right outer wall 4B, a rear outer wall 4C, and a left outer wall 4D. The four outer walls are intersected by four top sections 6A, 6B, 6C, and 6D which intersect outer sidewall surfaces 4A, 4B, 4C and 4D, respectively. A front inner wall 10A, right inner wall 10B, rear inner wall 10C and a left inner wall 10D intersect top surfaces 6A, 6B, 6C, and 6D respectively, and extend downward to meet floor surface 3A.

Floor surface 3A is everywhere sloped downward toward center drain hole 8.

An approximately U-shaped ridge extends from the above mentioned upper surfaces of base section 3 for mating with a corresponding ridge receiving groove disposed along the bottom of wall section 5, subsequently described. More specifically, sealing ridge 7 includes a short section 7E extending vertically from surface 6A. Ridge section 7E joins ridge section 7A, which extends upward from surface 6B and joins ridge section 7B. Ridge section 7B extends vertically from horizontal surface 6C. Ridge section 7B joins ridge section 7C, which extends upward from surface 6D. Ridge section 7D extends upward from surface 6A and joins ridge section 6D. The gap between the free ends of ridge sections 7D and 7E correspond to the entry opening of shower unit 1.

The structure of base section 3 can be further understood by reference to FIG. 7, which is a sectional view taken along section line 7—7 of FIG. 1. Referring now to FIG. 7, it is seen that sealing ridge sections 7A and 7C are anchored into the sidewalls of base section 3. For example, ridge section 7A is attached to a T-shaped anchor end 15A which is embedded in molded fiberglass materials from which the wall sections of shower base 3 are constructed, namely molded fiberglass. Similarly, ridge section 7C is attached to T-shaped end 15C, which is also embedded in one of the side walls of shower base 3. Ridge section 7B is attached to section 15B, which is embedded in the rear wall of shower base 3.

Still referring to FIG. 7, shower floor 3A is supported by rigid web supports 15, which are integrally molded with shower base 3 and extend outward in a radial pattern from adjacent drain hole 8.

Referring again to FIG. 1, wall section 5 includes a first wall section 5A, a second wall section 5B perpendicular to first wall section 5A, and a third wall section 5C perpendicular to the second wall section 5B and opposite and parallel to first wall section 5A.

Wall section 5 is composed primarily of molded fiberglass. An enlarged base flange 11 extends outwardly from the lower edges of wall panels 5A, 5B, and 5C (see FIG. 2). A ridge receiving groove 11C (bounded by two fingers 11A and 11B of base flange 11) receives ridge 7, previously described. The various sections 7A–7E of sealing ridge 7 are snuggly accomodated by ridge receiving groove 11C, so that when wall section 5 is placed on shower base 3, the entire sealing ridge 7A is tightly and snuggly sealed and accomodated by ridge receiving groove 11C and the inner surfaces of the shower wall section 5 and base section 3 are flush.

This produces a sufficiently tight sealing of shower wall section 5 to shower base section 3 that no leakage of water can occur between the boundaries of shower base section 3 and shower wall section 5. If desired, a suitable glue or cement can be applied to sealing ridge 7A and/or ridge receiving groove 11C to produce a permanent tight seal. The resulting fiberglass shower structure has all of the benefits of present single piece shower units, yet can be easily moved into an already constructed bathroom without tearing down the wall thereof to replace a pre-existing shower unit.

Wall unit 5 includes two upright posts 10A and 10B, to which a shower door can be subsequently attached, if desired. As seen in FIG. 3, which is a section view taken along section line 3-3 of FIG. 2, post 10A includes an inner section 13 which may be made of wood, covered by an outer layer 14 of molded fiberglass, which also provides the outer and inner surfaces of all other external surfaces of shower unit 1. (Those skilled in art will readily recognize that the internal frame structure of a molded fiberglass structure can be composed of wood.) Right post 10B is structurally similar to left post 10A.

Shower wall unit 5 includes a lower horizontal brace 21B and an upper horizontal brace 21A, which together provide a structural bracing for left side 5C of shower wall section 5.

Similar upper and lower horizontal braces still extend from the rear outer surface of wall 5A.

The structure of horizontal braces 21A and 21B are best understood by referring to FIG. 9, which is the sectional view taken along section line 9—9 of FIG. 1. Referring now to FIG. 9, it is seen that horizontal brace 21B includes an inner support section 17, which may be made of wood, covered by an outer layer 22 of molded fiberglass material.

Referring again to FIG. 1, it is seen that a pair of molded fiberglass nailing strips 9A and 9B extend forward from posts 10A and 10B. Nailing strips 9A and 9B can be utilized for nailing or otherwise attaching the left and right sides of wall section 5 to a framed, walled installation region into which shower unit 1 is installed.

A continuous upper lip section including, section 19A, 19B, and 19C, lies flush against the wall of an enclosure within which shower unit 1 is installed. Sections 19A, 19B, and 19C can be utilized as nailing strips or a suitable adhesive can be applied to their respective outer surfaces to attach the upper edges of shower unit 5 to the walls of the region within which shower unit 1 is to be installed. The precise structure of upper lip 19A is best seen by referring to FIG. 8, which is a sectional view taken along section line 8—8 of FIG. 1.

Referring now to FIG. 10, an alternate embodiment of the invention includes a molded fiberglass bathtub 30 and an upper wall section 40.

Bathtub 30 has a front surface 38 which is continuous with top surfaces 34A, 34B, 34C, and 34D of bathtub 30. A sealing ridge 36 having sections 36A, 36B, and 36C extend from the right, rear, and left upper surfaces of the bathtub 30.

Wall section 40 includes a left wall panel 43A, a rear wall panel 43B, and a left wall panel 43C. Left wall panel 43C has two horizontal braces 41A and 41B; similar horizontal reinforcement braces are attached to the outer walls of rear wall 43B and right wall 43A.

A bottom flange section 42 extends along the lower outer edges of wall sections 43C, 43B, and 43A in a manner similar to that previously discribed with reference to flange section 11 in FIG. 1.

Referring still to FIG. 10, flange section 42 has a ridge receiving slot completely analogous to ridge receiving slot 11C of FIG. 1. Sealing ridge 36 extends snuggly into the ridge receiving slot of wall section 40 of FIG. 10, thereby providing a tight seal between wall section 40 and bathtub 30. Suitable glue or cement can be utilized to rigidly attach wall section 40 to bathtub section 30, providing a bathtub structure which has all of the advantages of temporary single piece molded fiberglass bathtub units and yet can be transported into a pre-existing bathroom (without tearing down the walls thereof) and installed in a place of a previously removed bathtub.

FIG. 11, which shows a sectional view taken along section lines 11—11 of FIG. 10, illustrates how nailing strips 42A and 42B can be utilized to attach wall section 40 to studs 44 which support a wall panel 45.

The dotted lines 36B and 36C in FIG. 11 illustrate sealing ridge 36B and 36C tightly fitted into the ridge receiving slots of shower section 40.

While the invention has been described with reference to several embodiments thereof, those skilled in the art will be able to provide various obvious modifications to the total structures without departing from the true spirit and scope of the invention, as set forth in the appended claims.

I claim:

1. A two-piece molded fiberglass shower unit comprising in combination:

(a) a base section, said base section including a floor surface, a drain hole extending through the floor surface, a wall surrounding and continuous with said floor surface, a continuous top surface of said wall, and a continuous sealing ridge extending vertically from said top surface, said sealing ridge extending along a substantial portion of said top surface and leaving a gap corresponding to an entryway of said shower unit; and (b) a unitary wall section for attachment to said base section, said unitary wall section bounding a volume and having a side opening corresonding to and partially bounding the entry way of said shower unit, said unitary wall section including a continuous bottom flange, said bottom flange having therein a continuous ridge receiving slot for receiving said sealing ridge, said sealing ridge closely fitting in said ridge receiving slot for providing a sealed junction between said base section and said unitary wall section and for rigidly attaching said base section to said unitary wall section, whereby said base section can be installed or positioned before attachment of said unitary wall section thereto, said base section including a single piece section composed of molded fiberglass;

said base section being substantially rectangular, said base section having first, second, third and fourth sides, said sealing ridge extending along said first, second and third sides, said unitary wall section having first, second and third wall panels, said ridge receiving groove extending coextensively with said sealing ridge along said first, second and third wall panels of said wall section;

said unitary wall section including first and second flanges extending forward from said first and second wall panels, respectively, for effecting attachment of said unitary wall section to walls of a bounded shower unit installation region within which said shower unit is to be installed, said first and second flanges being flush with an outer surface of said first and second sides of said base section, whereby said flanges can be used as strips for nailing to the walls of the bounded shower unit installation region or for adhesive attachment thereto;

said unitary wall section including first, second and third horizontal reinforcing members attached to said first, second and third wall panels, respectively;

said wall of said base section having a vertical, upper, inner wall surface, said unitary wall section having a vertical lower, inner wall surface, said vertical, upper, inner wall surface being flush with said vertical, lower, inner wall surface when said base section is joined to said unitary wall section such that said sealing ridge extends entirely into said ridge receiving slot;

said wall of said base section having a vertical, upper, outer wall surface, said unitary wall section having a vertical, lower, outer wall surface, said vertical, upper, outer wall surface being flush with said vertical, lower, outer wall surface when said base section is joined to said unitary wall sections such that said sealing ridge extends entirely into said ridge-receiving slots;

said unitary wall section including first and second vertical posts bounding the entryway of said two-piece molded fiberglass shower unit, said first and second vertical posts being integral with said unitary wall section, there being no vertical joints between said first and second vertical posts and other portions of said unitary wall section, whereby said two-piece molded fiberglass shower unit avoids build-up of residue or mildew of the type that occurs in crevices, joints or seams that retain moisture in multi-piece shower units.

2. The molded fiberglass shower unit of claim 1 wherein said continuous sealing ridge includes a member anchored in said top surface, said member having an inverted T-shaped cross section.

3. The shower unit of claim 2 wherein said first and second vertical posts and said first, second and third horizontal reinforcing members each include wood beams or posts enclosed in molded fiberglass material whereby said wood can be used to receive nails for attachment of said wall section to the walls of the shower installation region.

4. The shower unit of claim 3 wherein said wall section includes a continuous top flange extending along the tops of said first, second and third walls, wherein said top flange can be used as a nailing strip or attachment strip for attaching the upper portion of said wall section to the walls of said shower installation region, the outer surfaces of said first flange, said first horizontal reinforcing member, and one section of said top flange being coplanar, the outer surfaces of said second flange, said third horizontal reinforcing member and a second section of said top flange being coplanar, and the outer surfaces of said third reinforcing member and a third portion of said top flange being coplanar.

5. The shower unit of claim 4 wherein said base section and said wall section are securely connected together by means of adhesive material binding said sealing ridge in said ridge receiving slot.

* * * * *

UNITED STATES PATENT AND TRADEMARK OFFICE

CERTIFICATE OF CORRECTION

PATENT NO. : 4,423,528

DATED : January 3, 1984

INVENTOR(S) : Charles A. Wiedmaier

It is certified that error appears in the above-identified patent and that said Letters Patent are hereby corrected as shown below:

In the inventor's name, delete "Wiedmeier", substitute --Wiedmaier--.

Signed and Sealed this

Second Day of April 1985

[SEAL]

*Attest:*

DONALD J. QUIGG

*Attesting Officer*

*Acting Commissioner of Patents and Trademarks*